United States Patent [19]

Casbeer, Jr.

[11] 4,404,769

[45] Sep. 20, 1983

[54] RODENT BARRIER FOR DOOR OVER RAILROAD TRACK

[76] Inventor: Jesse I. Casbeer, Jr., 7946 Cedel, Houston, Tex. 77055

[21] Appl. No.: 220,813

[22] Filed: Dec. 29, 1980

[51] Int. Cl.[3] ..... E04H 9/16

[52] U.S. Cl. ..... 49/58; 52/101

[58] Field of Search ..... 52/101; 49/58, 60, 404, 49/197; 238/10 R, 379, 381, 7, 9; 160/104, 229 R, 200; 104/100, 103

[56] References Cited

U.S. PATENT DOCUMENTS

| | | | |
|---|---|---|---|
| 580,594 | 4/1897 | Brady | 238/379 |
| 1,166,051 | 12/1915 | Kammer | 238/7 |
| 2,968,829 | 1/1961 | Meddick | 160/229 R |
| 3,630,439 | 12/1971 | Cook | 238/10 R |
| 3,816,610 | 6/1974 | Lusby | 52/101 |
| 4,102,093 | 7/1978 | Harris | 52/101 |

*Primary Examiner*—Peter M. Caun
*Assistant Examiner*—Cherney S. Lieberman
*Attorney, Agent, or Firm*—Pravel, Gambrell, Hewitt, Kirk & Kimball

[57] ABSTRACT

A rodent barrier system adapted for use with respect to a vertically closing door in a warehouse or other storage facility wherein the door moves downwardly to a closed position over a railroad track. The door rodent barrier includes channel members mounted on the inside of the rails of the railroad track, each channel member having a groove therein for receiving a detent portion of a complementary configuration, such detent portion being part of a barrier plate mounted onto the vertically closing door. In the closed position, the detent portions of the barrier plates are nested into the channels in the channel members thereby preventing the passage of rodents between the rails of the railroad track and the closed door.

10 Claims, 7 Drawing Figures

Fig.-5
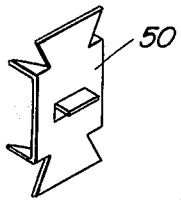
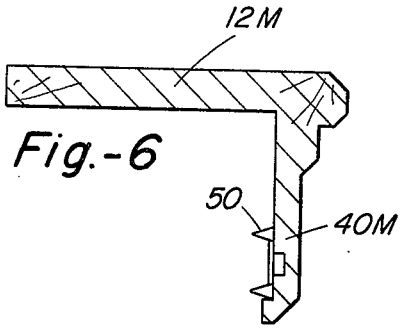
Fig.-6
Fig.-7
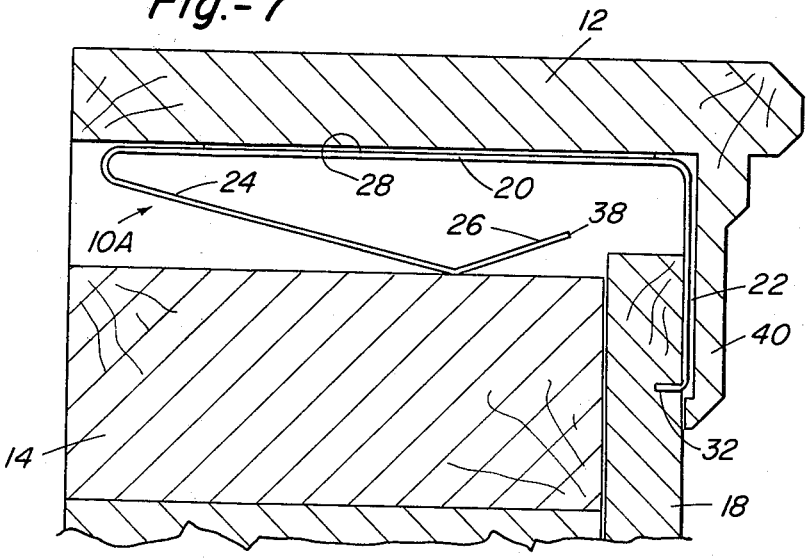
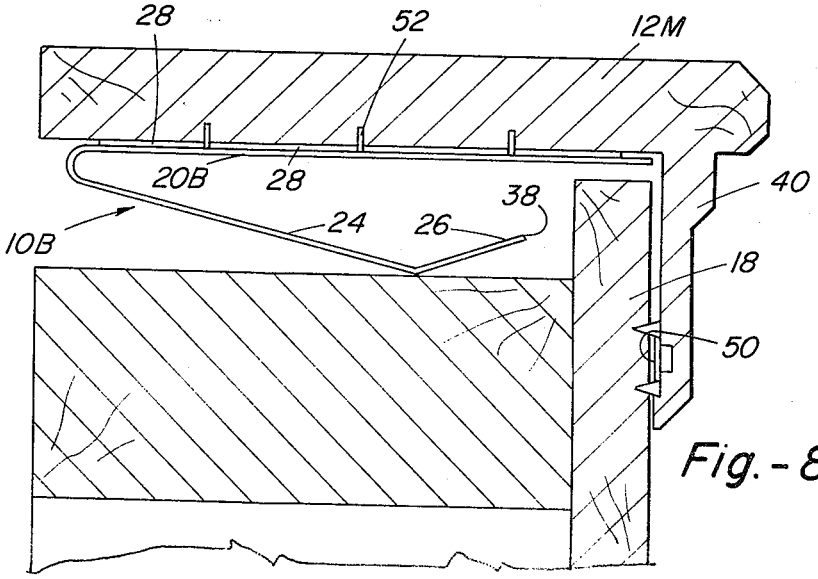
Fig.-8

RODENT BARRIER FOR DOOR OVER RAILROAD TRACK

TECHNICAL FIELD OF THE INVENTION

This invention relates to a rodent barrier for use with a door vertically closable over a railroad track.

There are many types of storage facilities and other structures which have railroad tracks laid into the facility so that goods may be moved in and out of the facility in great amounts. Typically, it is necessary to provide some type of closable door in the opening through which the railroad track is laid so that whenever necessary, the opening can be closed off. Due to the relatively large size of such openings, obviously necessarily large enough to receive railroad cars, it is common to use vertically closable doors. One of the problems with the use of such vertically closable doors over railroad tracks is the entry of rodents or other vermin into the warehouse facility. Typically, such a vertically closable door in its closed position is in contact with the surface of the warehouse or other facility floor, which may be flush with the top of the railroad tracks. However, it is necessary to provide space inside of the railroad tracks to allow for the passage of the railroad car wheels and it is this space which allows the entry of rodents even when the door is closed. This is a problem of great concern because such rodents can cause great damage to the contents of the warehouse or other facility, not only in terms of product loss but also in the terms of the spread of disease. Recently, it is understood that the federal government has become greatly concerned over the entry of such rodents and is placing pressure on the designers and constructors of new warehouse facilities to somehow cope with this problem and prevent the entry of rodents.

Insofar as known, there has not been a great deal of patent activity with respect to such rodent barriers. For the purposes of full disclosure, it is noted that U.S. Pat. Nos. 4,110,944; 2,395,635; 2,110,863; and, 574,305 deal with rodent protectors or guards. However, none of these patents disclose a device which can be used in the environment of this invention for the prevention of the entry of rodents between a railroad track and a vertically oriented, closed warehouse door.

SUMMARY OF THE INVENTION

In a storage or shipping facility such as a warehouse having a railroad track extending into the warehouse through a warehouse door opening closable with a vertically movable warehouse door, this invention provides apparatus for mounting with the warehouse door and with the railroad track rails mounted in the warehouse floor for preventing the entry of rodents or other vermin into the warehouse. The apparatus of the preferred embodiment of this invention includes channel members adapted to be mounted adjacent to the inside of each rail of the railroad track in an area directly below and in vertical alignment with the warehouse door.

A floor section is provided to seat the channel members and to extend transversely across the warehouse door opening along the line of the closed warehouse door to provide a surface area substantially flush with the top of the rails. Each of the channel members has a channel or groove formed therein in cooperation with the inside of such adjacent rail, the channel extending linearly along the length of the rail. And, barrier plates are adapted to be mounted on the warehouse door in vertical alignment with each of the channel members. Each of the barrier plates has a barrier detent portion depending downwardly therefrom, the detent portion having a configuration complementary to the configuration of the channels and the channel members so that the barrier detent portions are positionable in the channel member channels with the warehouse door in a closed position to prevent the entry of rodents or other vermin into the warehouse between the warehouse door and the rails.

This description of the invention is intended to be a summary only, it being understood that the exact scope of the invention is set forth in the following description of the preferred embodiment and in particular, in the claims set forth hereinafter.

BRIEF DESCRIPTION OF THE DRAWINGS

FIG. 5 is a cross-sectional view of the channel member of FIG. 4 illustrating the slope of the bottom of the channel and one side wall of the channel member groove;

FIG. 6 is a top view of the channel member; and

FIG. 7 is a side view of one of the barrier plates illustrating the complementary configuration of the depending detent portion adapted to fit into the channel member channel.

DESCRIPTION OF THE PREFERRED EMBODIMENT

Figure 1:
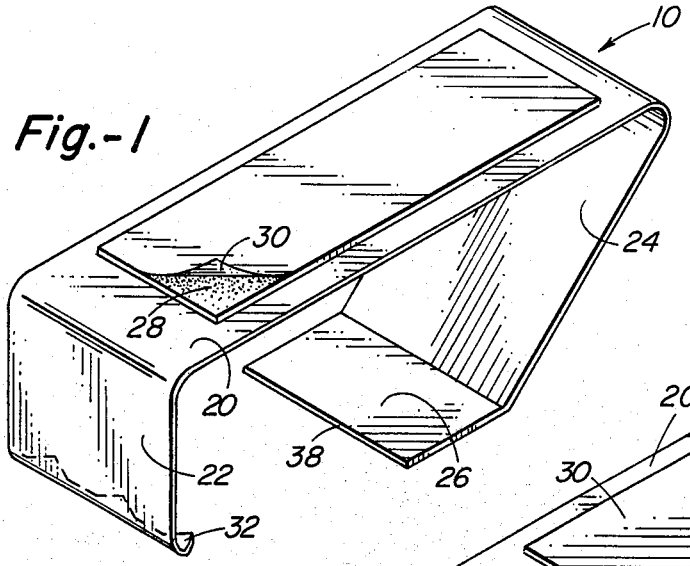
FIG. 1 is a side view partly in section of the door rodent barrier of the preferred embodiment of this invention with the warehouse or other vertically movable door being in a closed position.
Figure 3:
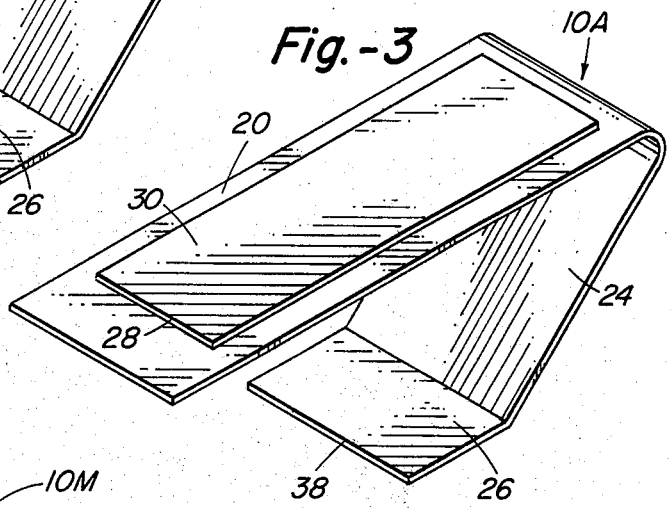
FIG. 3 is a sectional view taken along line 3—3 of FIG. 2 illustrating the details of mounting of the channel members adjacent to the inside of the rails of the railroad track.
Figure 2:
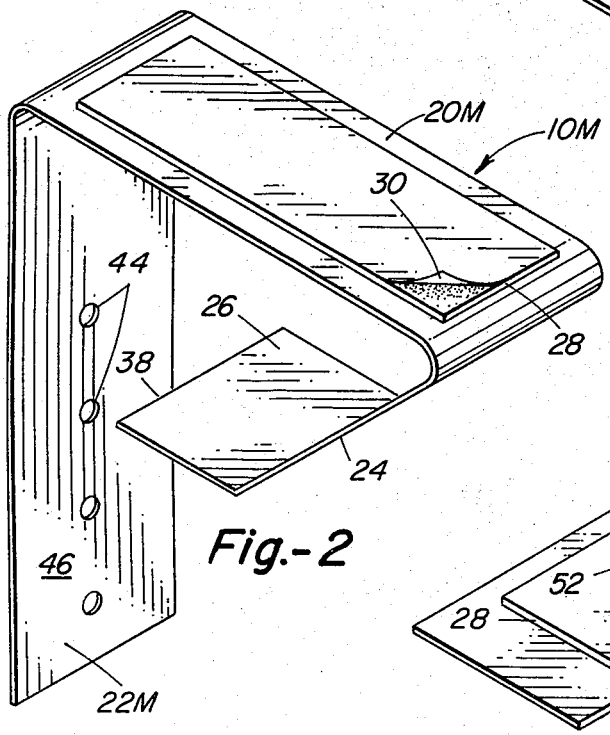
FIG. 2 is a sectional view taken along line 2—2 of FIG. 1 illustrating the relative position of the flush floor section and the channel members with respect to the vertically movable warehouse door.

Referring to the drawings, the letter B generally designates the door rodent barrier of the preferred embodiment of this invention. The door rodent barrier B of the preferred embodiment of this invention is adapted to be mounted with a vertically closable door D and with or in the floor F of a warehouse or other facility for preventing the entry of rodents between railroad tracks T laid through the doorway thereof and the closed door D. Typically, shipping or storage warehouses or facilities of a very large size have railroad tracks laid through one or more of the doorways of such warehouses in order to use railroad cars for shipping and receiving. In addition to such storage facilities or warehouses, there may be other types of structures wherein a railroad track is laid into the structure through a doorway which needs to be closed sufficiently tight to prevent the entry of rodents or the like. The door rodent barrier B of this invention applies to any such facility, even though hereinafter, the door D will be described with respect to a vertically movable door mounted across the doorway of a warehouse having railroad track T mounted in the floor F thereof. Referring in particular to FIGS. 2 and 3, the railroad track T includes rails R-1 and R-2 which are laid into the floor F of the warehouse.

It is of course well known to use vertically closable doors such as D to close such a warehouse door opening over the railroad track T. Typical doors of this variety consist of pivotally connected sections having rollers mounted in L-shaped slideways for moving the door between an upper, retracted substantially horizontal position and a lowered, closed position wherein the door is substantially vertically oriented.

It is further known to provide the warehouse floor F substantially flush with the rails R-1 and R-2 of the railroad track so that the closed warehouse door will generally prevent the entry of rodents or other vermin. However, whenever such a warehouse door is closed over rails R-1 and R-2, there is a space on the inside of each of the rails that is a particular problem area. It is necessary to leave such a space on the inside of the rails in order to receive the wheels of the railroad cars, and the closing of a typical warehouse door leaves this space open, which makes the warehouse vulnerable to the entry of rodents such as rats and the like.

The door rodent barrier B of the preferred embodiment of this invention is adapted to be mounted with the warehouse door D and the rails R-1 and R-2 of the railroad track T to prevent the entry of rodents between the door D and the rails R-1 and R-2 with the door in the closed position. Referring in particular to FIGS. 2 and 3, the door rodent barrier B includes a floor section 10 of concrete or other suitable material extending transversely of the warehouse opening in which the door D is mounted along the line 11 of closing of the warehouse door D to provide a surface 10*a* substantially flush with the tops of the rails R-1 and R-2. Basically, the floor section 10 is formed in three parts, 10*b*, 10*c* and 10*d*. The floor section parts 10*b* and 10*d* are substantially thicker and wider than the intermediate part 10*c* because the sections 10*b* and 10*d* assume more of the load of the railroad cars moving along the rails R-1 and R-2. Thus, the floor section part 10*c*, which acts to connect the thicker sections 10*b* and 10*d* may be somewhat narrower as viewed from the top in FIG. 2 and thinner as viewed from the side in FIG. 3.

The rails R-1 and R-2 extend through the floor section 10. For the purposes of definition, the rails R-1 and R-2 are of a typical I-shaped configuration of rails for railroad tracks. The rail R-1 may be defined as having a base portion 12*a*, an interconnecting vertical portion 12*b* and an integrally formed top portion 12*c* terminating in surface 12*d* which is substantially flush with the surface 10*a* of the floor section 10. The rail R-1 may be further defined as having an inside area generally designated as 12*e*, which includes an inside, top area portion or face 12*f* which is typically engaged by the rim of the wheels of the railroad cars. Similarly, the rail R-2 includes a base portion 14*a* integrally formed with an intermediate portion 14*b* and a top rail portion 14*c* having a top surface 14*d* substantially flush with the surface 10*a* of the floor section 10. The rail R-2 is further defined as having an inside area generally designated as 14*e* which includes a top inside area or face 14*f* which actually contacts part of the railroad car wheel.

A first channel member 15 is adapted to be mounted adjacent to and in partial engagement with the inside 12*e* ofthe rail R-1 and a second channel member 16 is adapted to be mounted adjacent to and in partial engagement with the inside 14*e* of the rail R-2. The channel members 15 and 16 are mounted in a position directly below and in vertical alignment with the closed warehouse door D in the concrete floor section parts 10*b* and 10*d*, respectively.

Each of the channel members 15 and 16 have formed therein a channel or groove 15*a* and 16*a*, respectively, adapted to provide a space through which a portion of the railroad car wheels can travel without damaging the channel members themselves. The channels 15*a* and 16*a* are positioned adjacent to and formed in part with the inside faces 12*f* and 14*f*, respectively, of the rails R-1 and R-2, respectively, and extend linearly along the length of the rails.

The warehouse door D has mounted thereon two sets or pairs 17 and 18 of barrier plates which are positioned in vertical alignment with the rails R-1 and R-2 and the channel members 15 and 16 attached thereto. The set of barrier plates 17 include barrier plates 17*a* and 17*b* and similarly, the set 18 of barrier plates include plates 18*a* and 18*b*. The plates 17*a* and 17*b* are mounted on either side of the warehouse door D at the bottom thereof and are bolted together by nut and bolt combinations such as 19 which extend through the door D into connection with each of the barrier plates. Referring to FIGS. 3 and 7, each of the barrier plates such as the barrier plate 18*a* (FIG. 7) include a barrier detent portion 20 which depends downwardly from the lower edge 18*c* of the barrier plate. Each of the barrier plates such as the barrier plate 18*a* is mounted onto the door D in such a position that the depending detent portion 20 is aligned with the channel or groove such as the groove 16*a* in the channel member 16. The barrier detent portion 20 has a configuration which is complementary to the configuration of the channel 16*a* in the channel member 16 such that the barrier detent portion 20 is nested in the channel 16*a* with the warehouse door D in a closed position to prevent the entry of rodents or other vermin into the warehouse between the door D and the rail R-2.

Figure 4:
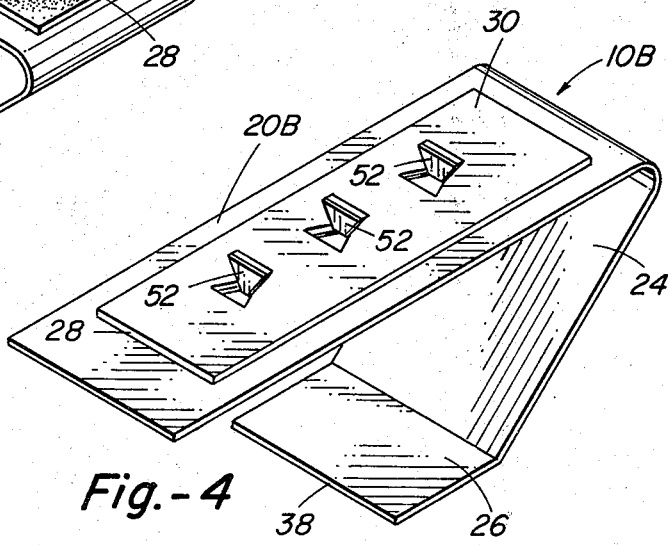
FIG. 4 is an end view of the channel member of this invention.
Figure 9:
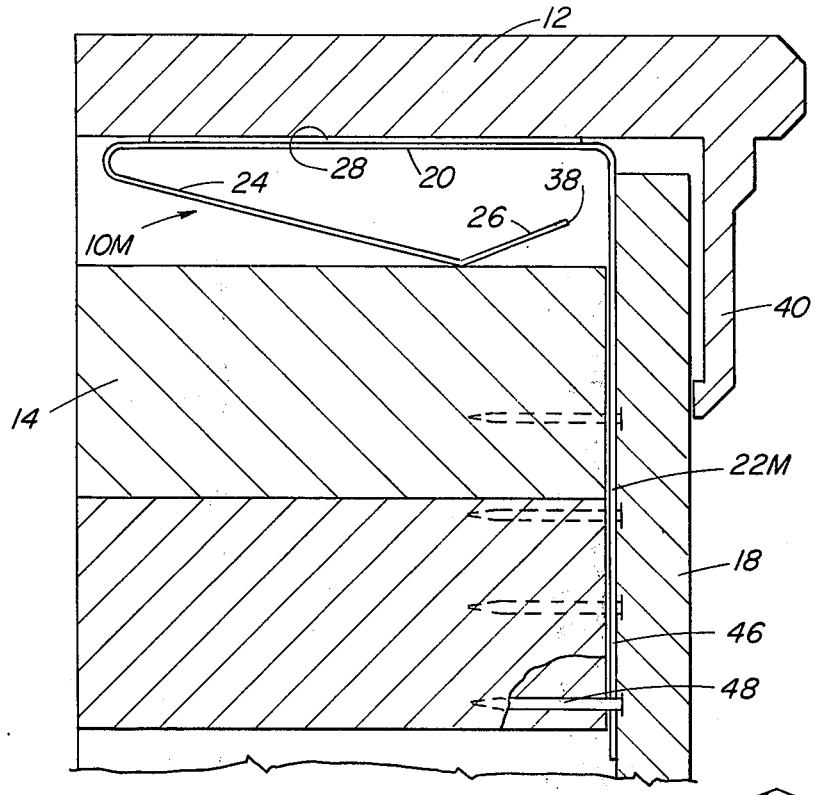
Figure 10:
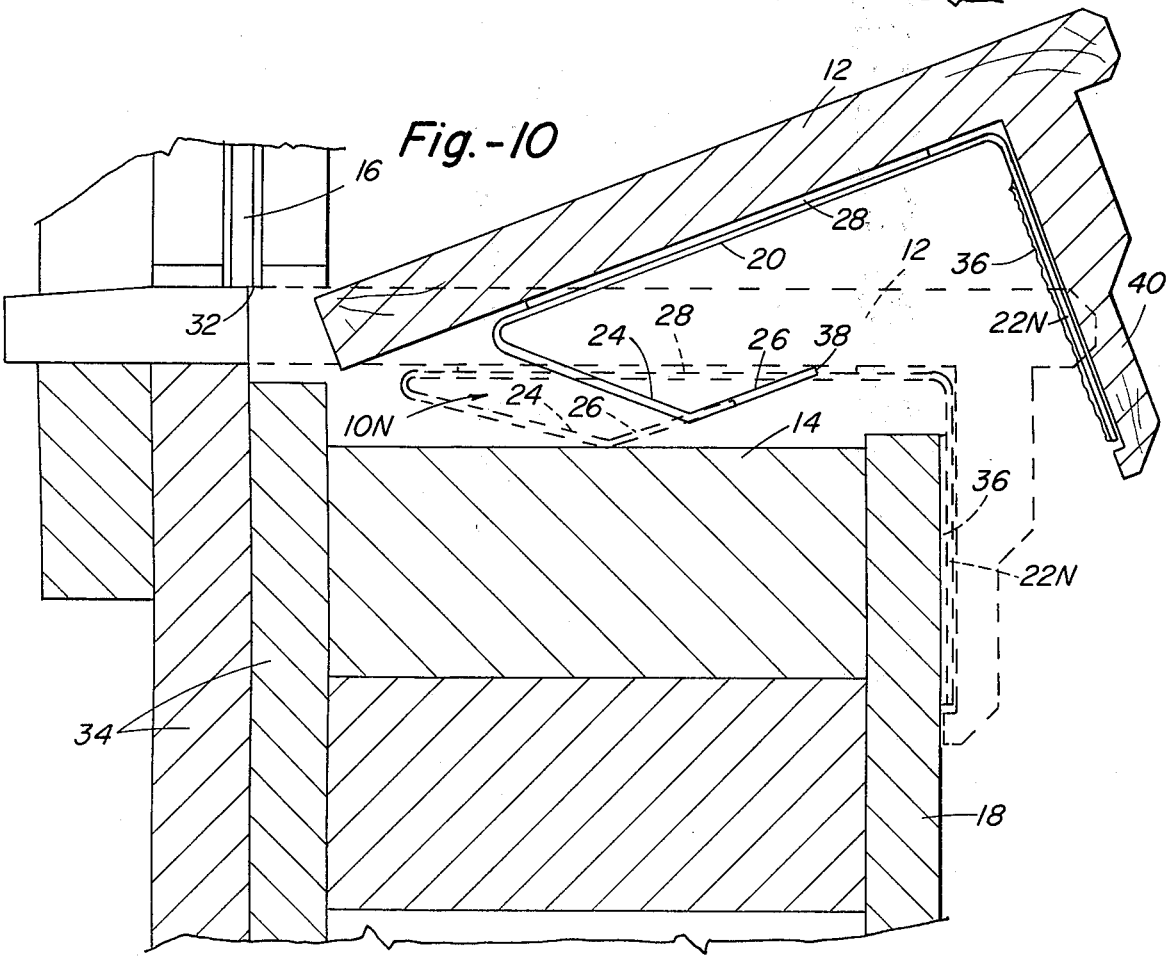
Figure 1:
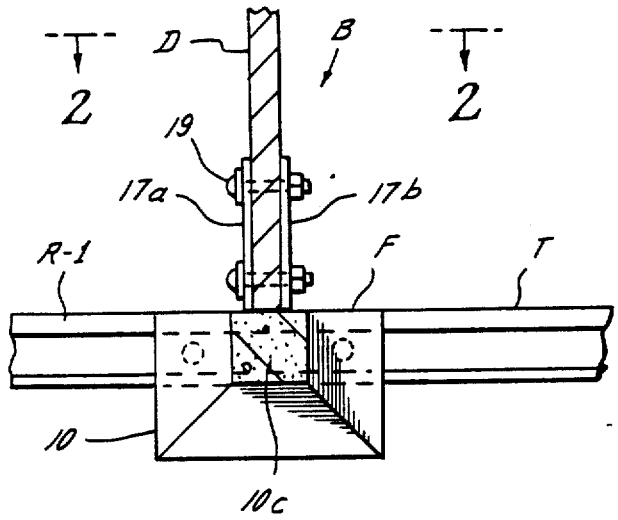
Figure 2:
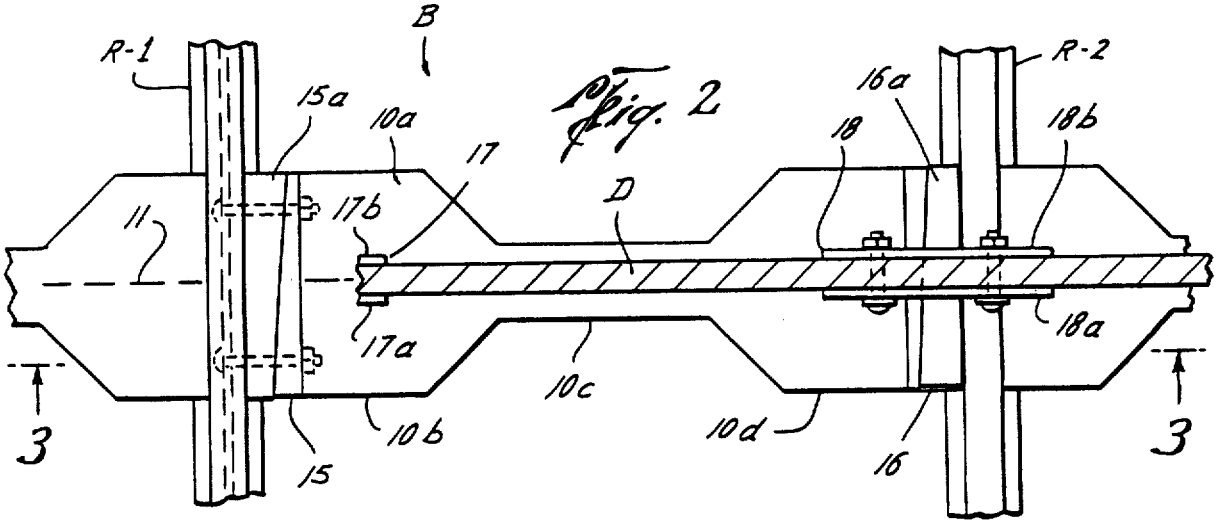
Figure 3:
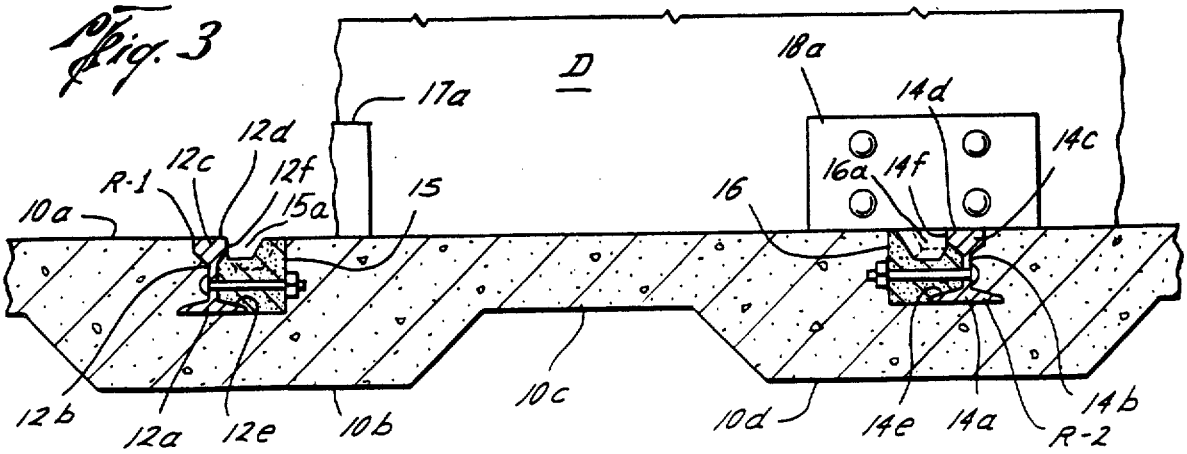

The channel 16*a* of channel member 16 is illustrated in detail in FIGS. 4–7. Referring to FIG. 4, the channel or groove 16*a* is located in top surface 16*b* of the channel member 16. The channel member 16 may be defined as having the general shape of a rectangular block. The channel member 16 includes a first flat side wall 16*c*, a bottom portion 16*d* and an inside wall consisting of faces 16*e*, 16*f* and 16*g*. The faces 16*e* and 16*f* are adapted to fit against the inside of the bottom section 14*a* of the rail R-2, and the face 16*g* is adapted to fit against the intermediate rail portion 14*b*. Inclined upper face 16*h* is adapted to fit against the under portion of the top rail section 14*c* with inside upper rail face 14*f* cooperating to form part of the complete channel or groove 16*a* in which the barrier detent portion 20 can be nested. The channel 16*a* is formed in the upper surface of the channel member 16, leaving only upper surface portion 16*b*, which is flush with floor section surface 10*a*.

Basically, the channel 16*a* includes a first side edge or wall 21*a* which is inclined toward a second side edge or wall 21*b*, which side walls are joined with bottom 21*c*. The side walls 21*a* and 21*b* thus converge toward each other and toward the bottom 21*c* to provide a wedging and centering action against the detent portion 20 of the barrier plate 18 as it is moved downwardly to a nested position. The bottom 21*c* is sloped downwardly from right to left as viewed in FIG. 5 such that the depth of the channel varies from the point of contact 22*a* of the detent portion of barrier plate 18*a* to the point of contact 22*b* of the detent portion of barrier plate 18*b*.

Therefore, the depth of the channel 16*a* at point 22*b* is greater than the depth of the channel at point 22*a*. The variation in channel depth causes a variation in the distance between converging side walls 21*a* and 21*b* at the sloping channel bottom 21*c*.

Referring to FIG. 7, the detent portion of the barrier plate 18*a* includes a first side edge 23 including portions 23*a* and 23*b* and a second side edge 23*c* and the bottom edge 23*d*. The side edge portion 23*a* is adapted to engage the inside rail face 14*f* of the rail R-2 and side edge 23*b* is adapted to engage the side wall 21*a* of the channel member groove 16*a*. Detent side edge 23*b* is parallel to channel wall 21*a* and detent side edge 23*c* is parallel to channel side edge wall 21*b*. The bottom 23*d* of the detent portion 20 is, of course, movable into engagement with the channel bottom 21*c* and the other side edge 23*c* of the detent portion 20 is movable into engagement with inclined side wall 21*b* of the channel 16*a* of channel member 16. When the warehouse door D is moved to a closed position, the detent portion 20 of the barrier plate 18*a* is moved downwardly into contact with the walls and bottom of the channel member groove 16*a* and with the inside face 14*f* of the rail R-2. In this manner, the depending detent portion 20 is moved into a fully nested position in engagement with the walls and bottom of the channel 16*a* to prevent the entry of rodents or other vermin between the door D and the channel member 16 and rail R-2.

As previously mentioned, the warehouse door D has mounted thereon two sets of the barrier plates generally designated as 17 and 18. The barrier plate 18*b* is virtually identical in configuration to the barrier plate 18*a*, the only difference being that the size of the depending portion 20 for the barrier plate 18*a* is slightly larger than that of plate 18*b* because the portion of the channel at the point of contact 22*b* is larger than the channel at the point of contact 22*a*. Thus, the height or distance d-1 between the bottom flat edge 18*c* of the barrier plate 18*a* to the bottom edge 23*d* of the depending portion 20, is greater for the plate 18*a* than the comparable distance d-2 is for the plate 18*b*.

In a similar manner, the channel member 15 is positioned adjacent to the inside of the rail R-1. The channel member 15 and its groove 15*a* is basically identical to that of the channel member 16 and its groove 16*a* except that the slope of the groove 15*a* is opposite to that of the groove 16*a*. Therefore, the detent portion 20 for the barrier plate 17*b* will be larger and deeper than the detent portion 20 for the barrier plate 17*a*. Otherwise, the barrier plates 17*a* and 17*b* and their depending portions 20 operate in virtually the same manner as the detent portions 20 of the barrier plates 18*a* and 18*b*.

In this manner, whenever it is desired to close the warehouse door D, the warehouse door is moved vertically downwardly and as the warehouse door D approaches the surface 10*a* of the floor section 10, the depending portions 20 of the barrier plates 17*a–b* and 18*a–b* move downwardly into the grooves 15*a* and 16*a*, respectively, of the channel members 15 and 16 until the depending portions are in full engagement with the side walls and bottoms of their respective channels. This seating of the depending portions 20 against the side edges and bottom of the channels closes all openings or voids otherwise left between a closing warehouse door D and the rails R-1 and R-2, thus preventing the entry of rodents and other vermin.

The foregoing disclosure and description of the invention are illustrative and explanatory thereof, and various changes in the size, shape and materials as well as in the details of the illustrated construction may be made without departing from the spirit of the invention. For example, it is contemplated that the apparatus of this invention may be utilized in various types of facilities using vertically movable closable doors or similar doors wherein it is necessary to prevent the entry of rodents or other vermin between the doors and railroad tracks.

I claim:

1. In a storage or shipping facility such as a warehouse having a railroad track extending into the warehouse through a warehouse door opening closable with a vertically movable warehouse door, apparatus for mounting with such warehouse door and with the railroad track mounted in the floor below such warehouse door for preventing the entry of rodents or other vermin, comprising:

channel members adapted to be mounted adjacent to the inside of each rail forming the railroad track directly below such a warehouse door in the closed position;

a floor section adapted to extend transversely of said warehouse opening along the line of closing of such warehouse door in the closed position to provide a surface area substantially flush with the top of such rails;

each of said channel members having a channel formed therein in cooperation with the inside of such adjacent rail, such channel extending linearly along the length of such rail; and barrier plates mounted with said warehouse door and in vertical alignment with each of said channel members and having depending downwardly therefrom barrier detent portions having a configuration complementary to the configuration of said channels in said channel members such that said barrier detent portions of said barrier plates extend downwardly into a nested position in said channel member channels with such warehouse door in a closed position to prevent the entry of rodents or other vermin into said warehouse between the warehouse door and the rails.

2. The apparatus set forth in claim 1, including:

a pair of said barrier plates mounted on each side of said warehouse door in vertical alignment with each of said channel members, each of said barrier plates having a barrier detent portion having a configuration complementary to the configuration of said channel in each of said channel members.

3. The apparatus set forth in claim 1, including:

said channel in each of said channel members includes first and second side walls inclined toward each other and a flat bottom.

4. The apparatus set forth in claim 3, including:

said side walls having a varying distance therebetween such that said channel varies in width.

5. The apparatus of claim 3 or 4, including:

said bottom being sloped with respect to said surface of said floor section.

6. The apparatus set forth in claim 3 or 4, wherein:

each of said barrier detent portions includes first and second side edges which are tapered inwardly parallel to said first and second side walls of said channel.

7. The apparatus of claim 5, including:

a pair of said barrier plates mounted on each side of said warehouse door in vertical alignment with each of said channel members, each of said barrier plates having a barrier detent portion having a configuration complementary to the configuration of said channel in each of said channel members; and each of said barrier detent portions having a height equal to the depth of said channel member formed by said sloped bottom in the area of entry.

8. The apparatus set forth in claim 1, wherein each of said channel members include:

said channel member being generally in the shape of a rectangular block with said channel being formed in the top surface thereof; and said channel member further including a side wall having a configuration complementary to that of said rail with said channel formed in said channel member including as part of one of its side walls an inside face of said rail.

9. The apparatus set forth in claim 3, wherein:

said channel members are positioned such that said first wall thereof is aligned with an inside face of said rail such that said rail forms part of said channel.

10. The apparatus set forth in claim 9, wherein:

each of said barrier detents includes a first side edge conforming to said first wall and inside face of said rail on one side of said channel and a second edge conforming to said second side wall of said channel.

* * * * *

UNITED STATES PATENT AND TRADEMARK OFFICE

CERTIFICATE OF CORRECTION

PATENT NO. : 4,404,769

DATED : September 20, 1983

INVENTOR(S) : Jesse I. Casbeer, Jr.

It is certified that error appears in the above-identified patent and that said Letters Patent is hereby corrected as shown below:

The title page should be deleted to appear as per attached title page.

The sheets of Drawings consisting of Figures 1-10 should be deleted to appear as per attached sheets.

Signed and Sealed this

*Fourth* Day of *September 1984*

[SEAL]

*Attest:*

GERALD J. MOSSINGHOFF

*Attesting Officer*

*Commissioner of Patents and Trademarks*

United States Patent [19]

Casbeer, Jr.

[11] 4,404,769

[45] Sep. 20, 1983

[54] RODENT BARRIER FOR DOOR OVER RAILROAD TRACK

[76] Inventor: Jesse I. Casbeer, Jr., 7946 Cedel, Houston, Tex. 77055

[21] Appl. No.: 220,813

[22] Filed: Dec. 29, 1980

[51] Int. Cl.[3] ..... E04H 9/16

[52] U.S. Cl. ..... 49/58; 52/101

[58] Field of Search ..... 52/101; 49/58, 60, 404, 49/197; 238/10 R, 379, 381, 7, 9; 160/104, 229 R, 200; 104/100, 103

[56] References Cited

U.S. PATENT DOCUMENTS

| | | | |
|---|---|---|---|
| 580,594 | 4/1897 | Brady | 238/379 |
| 1,166,051 | 12/1915 | Kammer | 238/7 |
| 2,968,829 | 1/1961 | Meddick | 160/229 R |
| 3,630,439 | 12/1971 | Cook | 238/10 R |
| 3,816,610 | 6/1974 | Lusby | 52/101 |
| 4,102,093 | 7/1978 | Harris | 52/101 |

*Primary Examiner*—Peter M. Caun
*Assistant Examiner*—Cherney S. Lieberman
*Attorney, Agent, or Firm*—Pravel, Gambrell, Hewitt, Kirk & Kimball

[57] ABSTRACT

A rodent barrier system adapted for use with respect to a vertically closing door in a warehouse or other storage facility wherein the door moves downwardly to a closed position over a railroad track. The door rodent barrier includes channel members mounted on the inside of the rails of the railroad track, each channel member having a groove therein for receiving a detent portion of a complementary configuration, such detent portion being part of a barrier plate mounted onto the vertically closing door. In the closed position, the detent portions of the barrier plates are nested into the channels in the channel members thereby preventing the passage of rodents between the rails of the railroad track and the closed door.

10 Claims, 7 Drawing Figures

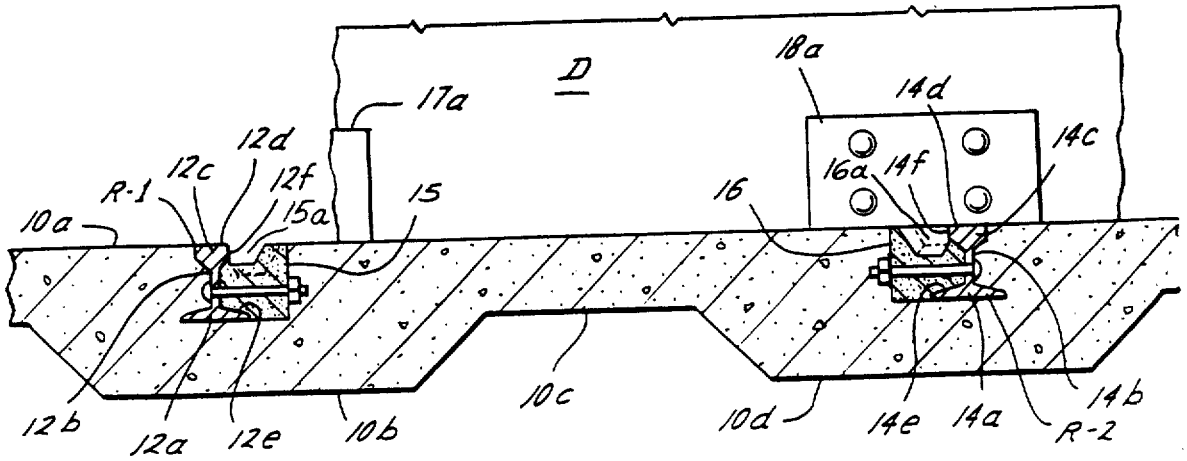

Fig. 4
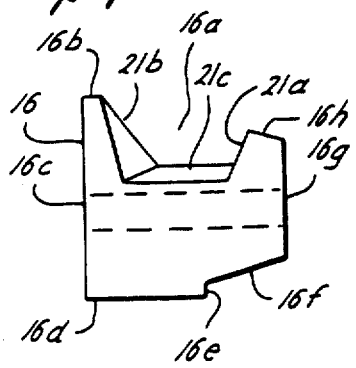
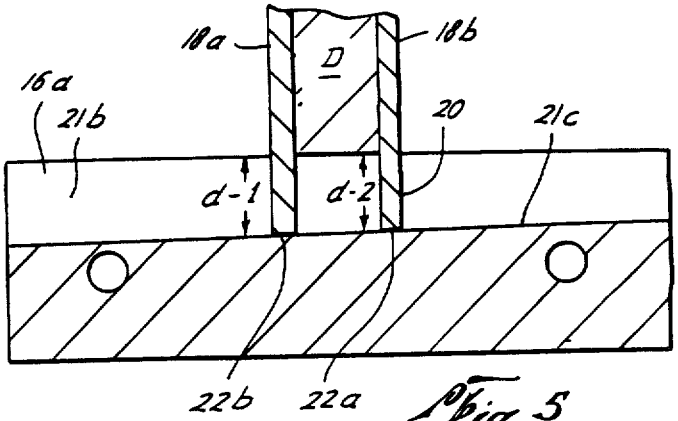
Fig. 5
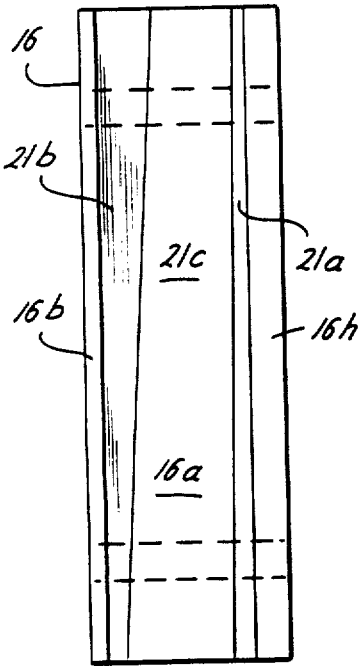
Fig. 6
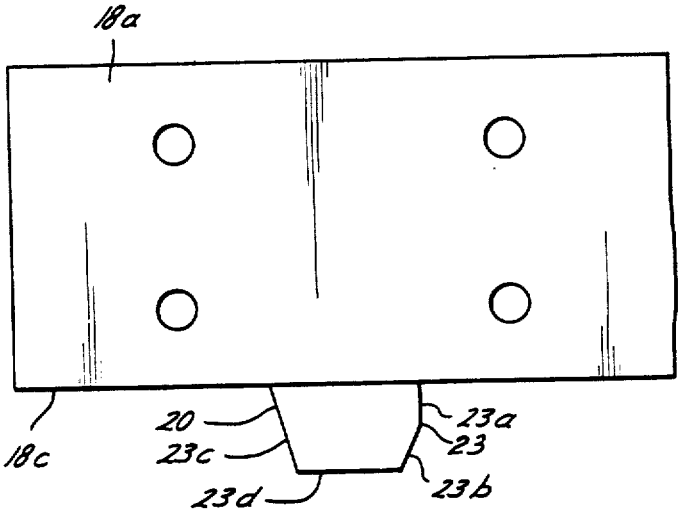
Fig. 7